US005477891A

United States Patent [19]

Benesi

[11] Patent Number: 5,477,891

[45] Date of Patent: Dec. 26, 1995

[54] WOVEN FILTER FABRIC

[76] Inventor: Steve C. Benesi, 611 McClay Rd., Novato, Calif. 94947

[21] Appl. No.: 272,026

[22] Filed: Jul. 8, 1994

[51] Int. Cl.[6] ..... D03D 1/00; D03D 15/00

[52] U.S. Cl. ..... 139/383 R; 139/420 A; 139/426 R; 428/257; 210/500.1

[58] Field of Search ..... 139/38 R, 383 A, 139/420 A, 426 R; 210/500.1, 500.21, 500.22; 428/225, 229, 257, 258

[56] References Cited

U.S. PATENT DOCUMENTS

| | | | |
|---|---|---|---|
| 1,536,533 | 5/1925 | Sheehan . | |
| 3,214,329 | 10/1965 | Wicker . | |
| 3,550,956 | 12/1970 | Lowe | 139/383 R |
| 3,573,164 | 3/1971 | Friedberg et al. | 139/383 A |
| 3,705,079 | 12/1972 | Lee et al. . | |
| 3,851,681 | 12/1974 | Egan | 139/383 A X |
| 4,016,911 | 4/1977 | Looker | 139/383 R |
| 4,457,968 | 7/1984 | Harvey | 139/383 A X |
| 4,989,647 | 2/1991 | Marchand | 139/383 A |
| 5,023,132 | 6/1991 | Stanley et al. | 428/257 |
| 5,059,318 | 10/1991 | Benesi . | |
| 5,094,719 | 3/1992 | Fry . | |
| 5,116,478 | 5/1992 | Tate et al. . | |
| 5,169,709 | 12/1992 | Fleisher | 139/383 A |
| 5,292,434 | 3/1994 | Benesi . | |
| 5,297,590 | 3/1994 | Fleischer | 139/383 A |

*Primary Examiner*—Andy Falik
*Attorney, Agent, or Firm*—George W. Wasson

[57] ABSTRACT

A woven fabric filter medium having particular use in a pressure filter apparatus. The fabric is useful in separating liquids from solids in a slurry fed into the pressure filter apparatus. The fabric is woven in a pattern and of materials that provide desired permeability while being capable of capture of the solids in the slurry and permitting the fluids to flow through. The materials used in the fabric are selected for their ability to resist deterioration from the chemical, heat or abrasive characteristics of the slurry while being capable of being cleaned for reuse in a filter apparatus.

23 Claims, 2 Drawing Sheets

WOVEN FILTER FABRIC

This invention relates to a woven fabric filter medium and more particularly to a method of forming the medium and to the materials woven to make the fabric filter medium.

BACKGROUND OF THE INVENTION

Filter apparatus using filter mediums are shown in my issued patents U.S. Pat. No. 5,059,318 issued Oct. 22, 1991 for Fluid Seal For A Travelling Sheet Filter Press and U.S. Pat. No. 5,292,434 issued Mar. 8, 1994 for Filter Apparatus And Method Using Belt Filter Medium. In such filters separable plate members are [Dressed together to form a filter chamber. The plates have mating surfaces and hollow interior portions that create a filter chamber. A filter medium is placed between the mating surfaces before the plates are closed. In the usual operation, a slurry of liquid and solids is introduced into the formed chamber above the filter medium and, in a series of operations that may include forcing wash fluids, liquids or gasses through the slurry within the chamber, fluids are forced out of the slurry and through the filter medium to produce a dry filter cake of solids on the filter medium within the chamber. The plates may then be separated leaving the filter cake on the filter medium and the filter medium may be advanced out of the filter chamber to be replaced by a clean filter medium for a repeat operation of the filter mechanism. The filter medium may be advanced to a dump position for the filter cake and then cleaned and reused or may be discarded.

Because slurries are of varied formation and characteristics the filter medium used in the filter apparatus shown in my issued patents and in functionally similar filter apparatus frequently are specifically designed for the slurry being encountered. Some slurries include coarse solids and some include almost colloidal suspensions of fine solids. Filter media for filter apparatus operating with these variations in particle size need to be designed to provide the desired permeability for the media while providing a media with openings that will capture the smallest particles that are desired to be retained. The filter media must also be capable of performing the desired filter operation without becoming clogged by retained solids.

In designing a filter media that is intended for repeated uses, it is desirable to produce a filter media that will release the produced filter cake and may be easily cleaned for reuse in the filter chamber.

Slurries are also of varying chemical characteristics; some being toxic, some caustic, some acidic, some hot, some cold. Filter media designed for these different chemical characteristics may be woven with fibers that can withstand the conditions to be encountered within the filter chamber.

FIELD OF THE INVENTION

Filter media of the type used in pressure filters described above are usually woven of selected yarns. The yarns may be monofilaments or multifilaments or spun of man-made or natural origin. The yarns are woven in suitable weaving looms that are operated under controllable conditions to produce the desired weave of yarns. Woven fabrics are described by their warp yarn and their weft yarn, the fibers used in each of those yarns, the number of warp yarns per inch, the number of weft yarns per inch, the weight per square yard for the woven fabric, and the treatments during or after weaving for the woven fabric.

In a weaving loom there are provisions for a plurality of warp yarns across the loom. Each warp yarn is withdrawn from its own yarn spool or may be positioned on a supply beam and strung through a harness that moves the individual warp yarns up or down while a rapier or shuttle quill runs weft yarns through the wedge created by the specific warp yarns. The warp yarns extend in the direction of the loom; that direction being referred to as "machine" direction. Each warp yarn is separated from its adjacent yarn and the loom is equipped with means for moving the warp yarns with respect to each other and the loom to provide for different weave patterns. The warp yarns usually are tensioned by applying a force against the yarn as it is drawn from a spool or supply beam within the loom. The number of warp yarns in a fabric is referred to as "ends per inch" or the number of warp yarns in a linear inch in the cross machine direction of the fabric.

The weaving loom has provisions for passing weft yarns across the loom and between warp yarns. The weft yarns extend across the loom; that direction being referred to as "cross machine" direction. Each weft yarn is passed across the loom and may be a continuous yarn that returns through the loom after each cross machine path or is cut at the end of each pass. Each path across the loom may be with a different positioning of the warp yarns so as to produce the desired weave. Weft yarns are pressed against the previous adjacent weft yarn with a comb-like bar for packing each weft yarn. The woven fabric may pass over rollers, through an oven for heat treatment and over a load sensing beam to a take-up roll all under controllable tensions. The speed of take up or accumulation of the woven fabric on a spool or roll or the like may be used to determine the proximity of adjacent of weft yarns or packing of the yarns in a weave. The number of weft yarns per inch in a woven fabric is referred to as "picks per inch" or the number of weft yarns in a linear inch in the machine direction of the fabric. A "pick" is a single weft or fill yarn along the fabric; those weft yarns may be a multifilament, a monofilament or a spun yarn.

Yarns include single monofilament fibers, multifilament fibers, spun yarns and twisted combinations of either or both of such fibers. Multifilament fibers may be twisted or untwisted and may be wrapped with fibers of the same or different fibers. Yarns may be described in terms of denier which is the weight in grams of 9,000 meters of yarn before heat shrinking. Spun yarns are measured in "cotton count" which is the number of 840 yard hanks of yarn per pound. The higher the cotton count number, the smaller the yarn. Spun yarns are identified by two numbers, for example 4.00/2. The first number is the cotton count of 840 hanks per pound and the second number is the number of plies twisted together to form the yarn. Each ply of a multi-ply yarn can be twisted and when two or more twisted yarns are used, those twisted yarns can be twisted with each other to form a single yarn. Twist in a yarn is measured in "twists per inch". When twisted yarns are used in a fabric, the yarns with less twists per inch can produce a weave with less permeability and can prevent penetration of particles in the filtration process.

Monofilament yarns can be used in the cross machine direction yarns and can be sized for more "packing" or picks per inch. Smaller monofilament yarns in a weave can create a less permeable, more stable fabric with higher particle capture, with other variable being the same. Larger monofilaments result in fewer picks per inch, less dimensional stability and higher permeability, with all other variables being the same.

In weaving fabrics the tension and heat applied to the individual yarns may be used to produce "crimp" in the yarns. Crimp is defined as a percent and is the amount of loss in length of a specific length of yarn.

Weaving patterns produced by variations in the movement of adjacent warp yarns are known. One such pattern is referred to as a "twill" weave. In a twill weave, the pattern of movement of adjacent ward yarns is controlled in a repeating manner such that groups of warp yarns are moved for each passage of a weft yarn across the loom. Twill weaves can be uniform, that is repeating with the same changes of warp yarn movement on each pass of a weft yarn or may be a "broken" twill where the movement of adjacent warp yarns may be in groups and the groups may be in a controlled pattern that is not uniform for each weft passage but is repeating in some pattern order. Weaving looms may be controlled to produce almost any desired pattern of weaves.

SUMMARY OF THE INVENTION

Woven fabrics are known for use as filter media but no known woven fabrics have been specifically designed for the applications in pressure filters for slurry separations. Pressure filters require the filter media to be capable of operation in the pressure and environment of the slurry being treated in the filter. Fabrics for filter media in such operations may need to be specifically designed for the slurry being filtered. Further, the fabrics must be dimensionally stable and capable of being transported through the filter apparatus and sealed between the plates that form the filtration chamber. The woven filter media described herein is capable of being woven in a manner and of materials that will perform the desired functions.

In accord with the present invention, a woven fabric filter medium is produced that will meet a set of criteria for the filtration process that is to be performed. By establishing the size of the warp and weft yarns in the weaving of the fabric it is possible to produce a fabric that will have the desired permeability and particle capture characteristic that is needed. By selecting the proper yarn materials the woven medium can be designed to meet the physical and chemical conditions that will occur in the filtering process.

The fabric that is produced in accord with the method and materials herein disclosed is capable of being woven in a pattern that will produce the desired permeability and capture for the media. By selecting the appropriate warp yarns and the spacing of the warp yarns in the loom it is possible to use smaller yarns to establish more picks per inch in the cross machine direction and to create a less permeable, more dimensionally stable fabric with higher particle capture; or with the use of a larger monofilament warp yarn and fewer picks per inch to create a more permeable, less stable medium that will capture larger slurry solids.

Fabrics woven as described herein and heat treated under tensioned conditions applied to the warp yarns can produce desired crimp in the weft yarns and can produce more dimensionally stable fabrics. With the desired amount of crimp in the yarns, the woven fabric can be stable in the machine direction, cross machine direction and in diagonal directions thus creating a uniformly stable fabric.

The use of spun yarns in the weft yarns can be used to improve the capture characteristic of the woven fabric. Multifilament yarns passing across the weave can also create improved capture characteristics. The selection of different yarns can improve the wear characteristic of the resultant yarn. In accord with the present invention, multifilament yarns are produced by twisting filaments to produce a first twisted yarn and then that twisted yarn is twisted with another twisted multifilament yarn to produce one warp or weft yarn. The yarns twisted to produce the twisted weft yarn can be selected to produce a desired yarn weight that may be crimped to the desired percent crimp.

Preshrunk, high modulus yarns may be used to achieve a desired chemical, heat or abrasion resistance. Polyester, polyproplyene, nylon or other synthetic fibers as well as glass fibers can be used to accomplish a desired resultant yarn. Combinations of synthetic, natural and manmade fibers can be used.

It is therefore an object of the present invention to produce an improved woven fabric filter medium that will be dimensionally stable, of designable permeability and capture, easily movable within a filter mechanism, and easily cleanable for reuse.

Another object in accord with the preceding object is a method for producing an improved woven fabric filter medium.

Further objects and features of the present invention will be readily apparent to those skilled in the art from the appended drawings and specification illustrating preferred embodiments wherein:

DESCRIPTION OF THE PREFERRED EMBODIMENT

Figure 1:
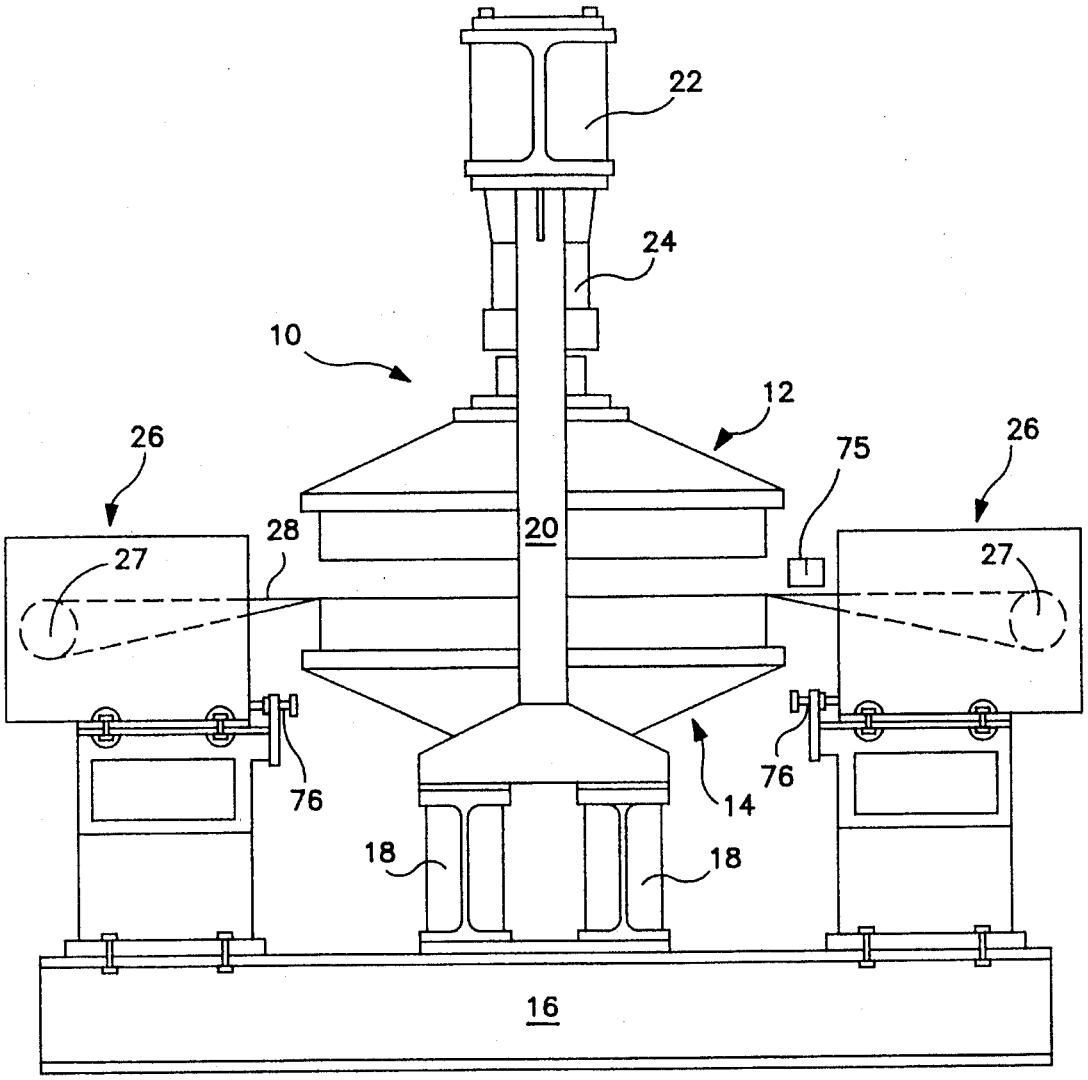
FIG. 1 is an elevational view a filter apparatus adapted for use of the woven fabric filter medium of the present invention.

As illustrated in the assembly drawing of FIG. 1, the filter apparatus 10 that would use a filter medium produced in accord with the present invention comprises a pair of plate members, an upper plate member 12 and a lower plate member 14, supported on and relatively movable within a support frame assembly comprising a pair of base beams 16, a pair of lower strongback members 18, a pair of spaced tension columns 20, and an upper strongback member 22. The support frame assembly is an assembly of the lower strongback members 18 on the base beams 16 with the spaced tension columns 20 mounted on the lower strongback member 18 and the upper strongback member 22 mounted on the tension columns. The frame assembly has an open interior portion for the support of the lower plate member 14 on the lower strongback 18, with suitable spacing and bracing. The upper plate member 12 is suspended from the upper strongback 22. A hydraulic jack mechanism 24 is provided between the upper plate member 12 and the upper strongback 22. As shown in FIG. 1 for a continuous belt operation, at each side of the assembly and mounted on the base beams 16, a pair of filter belt drive, treatment and washing assemblies 26 including rollers 27 are mounted for movement and treatment of a filter belt 28; the feed or drive function and the treatment and washing function can be performed at either side of the assembly. It should also be understood that in the alternative form of the apparatus using a disposable medium, there will be a different feed apparatus; however, the medium will be placed in the same location within the chamber and advanced with each operation of the apparatus.

The assembled filter apparatus of the present invention is adapted to open and close the plate members placing the upper plate member 12 in contact with lower plate member 14. When the plate members are closed, the filter medium 28 is between the upper plate 12 and the lower plate 14. The hydraulic jack mechanism 24 has been operated to force the plates together at a force at least exceeding the force created by the pressurized fluid with the filter medium in between the plates to seal the filter chamber that is created between the closed plates.

As described in my issued U.S. Pat. No. 5,292,434, the filter apparatus may be operated to perform a series of operational steps for the treatment of a slurry within the closed chamber so as to produce the desired filter cake or desired filtrate. Such steps can include preliminary slurry washes, pressure fluid washes or gas blowdown through the chamber, as well as treatment of the filter cake after fluids have been removed all for the purpose of separating solids from liquids and retaining the solids within the chamber on the filter medium. Those particular treatment steps do not form a part of this application except to the extent that the steps cause the movement of solid particles within the slurry and the capture of those particles on the filter medium. Each slurry or each process that produces a slurry may differ because of the size of particles within the slurry or because of the chemical make-up of either the liquid or the solid portions of the slurry. The filter medium of the present invention is designed to perform its function based on the characteristics of the slurry that is to be separated.

In pressure filtration of slurry, woven filter media is commonly used to separate liquid from solids. The weaving of such woven filter media involves the placement of warp and weft yarns in a prescribed pattern to produce a desired weave. Weaving is performed with a loom that has a machine direction representing the linear dimension of a fabric woven in the loom and a cross machine direction representing the dimension across the woven fabric. Machine direction yarns are referred to as warp yarns; cross machine directions are referred to as weft yarns. Warp yarns are usually uniformly spaced across the loom in parallel paths with the individual yarns drawn from separate spools or a beam and across a bar through separate harness eyes and controllers that permit each warp yarn to be moved with respect to the axis of the loom. Cross machine direction yarns, the weft yarns, are passed across the loom between the warp yarns. The weft yarns are separately placed and can be a single pass yarn or a continuous yarn from a spool, returning through the loom to produce the desired finished edge on the resultant woven fabric. The weft yarns can be pressed into the warp yarns to produce the desired density of a woven fabric.

The resultant woven fabric is usually accumulated on some from of accumulator, such as a spool. The rate of accumulation of the woven fabric and the rate of passage of the weft yarns across the loom can determine the density or tightness of the woven fabric. Tension of the warp yarns can also determine the tightness of the weave and the bending or crimp of weft yarns as the woven fabric is further treated. The present invention is directed to the selection and control of the warp and weft yarns, the control of the loom, the treatment of the woven fabric during and after the weaving to accomplish the formation of a preferred woven fabric filter medium for use with a pressure filter apparatus.

Characteristics of the slurry to be filtered are a major factor in determining a suitable woven material to effectively separate liquid from solids. It is known that woven media with smaller openings than the particle size of the solids in the slurry may retain the slurry solids while allowing the liquid to pass. It is also known that though an opening in the woven material may be larger than the particle size, a tortuous path through the woven media may prevent the particle from passing through the media.

The use of monofilament, multifilament and spun yarns of several weights, materials and weaves is also known as well as limits of materials used. The material limits include:

1. exceeding certain temperatures where properties of the fabric may break down,
2. chemical or pH limits of the material used, or
3. any of several factors, such as durability, swell, stretching, etc.

Use of woven filter media that also serves as a belt to transport filtered solids is known. Thus filter belts must be suitable for both filtering slurries and also serve as a belt to move retained solids from the filter area to a disposal or processing site. The belt characteristic of such filter fabric may include:

1. dimensional stability of fabric with resistance to stretching and shrinking under varying conditions including heat, moisture, chemical attack, high load tension,
2. durability with resistance to wear,
3. strength to pull solids retained on the belt and strength to overcome inertia when the loaded portion of the filter belt is first moved from the filter area.

Some of the problems associated with tracking and filtering characteristics of filter media within the filter apparatus include:

1. weave opening or stretching in areas of the belt fabric when tension is applied to the belt causing the belt to become misaligned and to track to one side of the chamber,
2. bowing of the fabric,
3. shrinking of the weft (width) of the belt,
4. loss of belt tension from stretching of the fabric resulting in belt drive means being not effective in pulling retained solids and the belt from the filter chamber,
5. changing filtration characteristics from non-uniform fabric,
6. shrinking of the fabric from exposure to heat or drying out of the material,
7. overtightening of the fabric with tearing or pulling of seams in the belt,
8. swelling of yarns with accompanying changes in filtration characteristics such as blinding.

Several techniques may be used to prevent these problems. The following techniques are applied to provide fabrics with a combination of superior filtration characteristics and superior belting characteristics.

1. Dimensional stability of fabric to facilitate tracking; This can be accomplished by:
   a) heat setting-pulling fabric through an oven,
   b) heat setting under certain speed, with a certain load on the woven fabric takeup roll,
   c) heat setting using a "tenter frame" where weft is stretched across the frame while heat is applied,
   d) resin treating of fabric and heat-activating the resin,
   e) using resin treated yarns,
   f) using preshrunk yarns,
   g) using heat activated adhesive yarns,
   h) pulling and monitoring each yarn with load sensors during the weaving process,
   i) stretching woven fabric under certain loads,
   j) using yarn (or multiple yarn to replace large single yarn) that will crimp during the weaving or finishing,
   k) calendaring the fabric usually between two rollers under pressure. Rollers can be heated to a certain temperature. The speed of the fabric going through the rollers is controlled and the pressure of the rollers on the fabric is controlled.
2. Permeability of the fabric; permeability is controlled by:
   a) yarn type-monofilament, multifilament, or spun,
   b) yarn size as measured in micrometers or denier (weight per unit) in case of monofilament, denier in case of multifilament, and cotton count is case of spun,
   c) yarn material: polyester, polyproplyene, nylon, kedlar, saran, glass, cotton, etc.-some fibers swell under certain conditions, some fibers are hydrophyllic, some are hydrophobic, some facilitate weaving and fitting "picks" or yarns per inch, some are difficult to weave and only a limited amount of picks per inch can be used,some materials are heat and chemical resistant, etc.,
   d) picks per inch, monofilament, multifilament or spun, multiple yarns spun together, heaviness of spun yarn inclusion,
   e) heat applied during weaving,
   f) amount of stretch or pull load on the fabric,
   g) resin impregnation of yarn used on fabric.

I have found that certain problems in the filter medium can be avoided by the proper selection of yarns for the warp and weft in the weaving process, for example:

1. If the fabric tracks to one side in part due to warp yarns moving along "rigid" 20 mil weft yarns. A solution is to use smaller diameter weft monofilament yarns and increase the number of weft yarns per inch. Bending of the smaller weft yarns keeps the warp yarns in place and stabilizes the fabric dimensionally.
2. If the belt shrinks both in warp (length) and weft (width) from exposure to heat and shrinking of open weave; the weft shrinks and does not cover filter area well; the warp shrinks and does not track well; the belt life is reduced also from blinding from shrinking pores. A solution is to use high modulus heat set yarns and more yarns per inch. Use heat set yarns in both the warp and the weft. Pull (stretch) the fabric and heat set. Heat set of weft yarns with a tenter frame. Use of heat set yarn also helps reduce blinding.
3. If the belt slips on drive rollers because the fabric stretches (opens) on one side and does not wrap around the drive roller uniformily. The solution suggested above in 2 and further balance the load across the full width of the fabric when stretching and heat setting.

EXAMPLES

The following fabrics have been woven in the manner just identified.

| | | |
|---|---|---|
| Fabric No. 1 | | |
| Warp: | 70 EPI | 2/1000 denier or one 2000 denier. |
| Weft: | 20–32 PPI | 2×(9 to 13 mil monofilament with 4.00/1, 6.00/1 or 8.00/2 spun yarns) twisted together. |
| Fabric No. 2 | | |
| Warp: | 70 EPI | 2/1000 denier or one 2000 denier. |
| Weft: | 21–37 PPI | Fiberglass filament core with spun wrap (dref yarn) |
| Fabric No.3 | | |
| Warp: | 70 EPI | 2/1000 denier or one 2000 denier. |
| Weft: | 21–38 PPI | 2/1000 denier or one 2000 denier. |
| Fabric No. 4 | | |
| Warp: | 70 EPI | 2/1000 denier or one 2000 denire. |
| Weft: | 21–32 PPI | 3.50/1 or (2.5–4.0)/1 or (6.00–8.00)/2 spun yarns. |
| Fabric No. 5 | | |
| Warp: | 70 EPI | 2/1000 denier or one 2000 denier. |
| Weft: | 20–40 PPI | one 9-18 mil monofilament or two to four 4-9 mil monofilament. |
| Fabric No. 6 | | |
| Warp: | 120–140 EPI | Two 1500 denier yarns pulled through the same harness eye and pulled without twisting. |
| | 60–70 × 2 EPI | Two distinct yarns multifilament. |
| Weft: | 22–28 PPI | one 15 mil +/– .002 monofilament. |
| Fabric No. 7 | | |
| Warp: | 120–140 EPI | Two 1500 denier yarns pulled as in Fabric No. 6 through the same harness eye. |
| Weft: | 19.5–24 PPI | 19-20.5 mil monofilament. |

All of the above fabrics can be made with polyester, polyproplyene or nylon yarns of pre-shrunk multifilament or monofilament yarns. These yarns are chemical, heat and abrasion resistant yarns. All of the fabrics utilize 200 pound to 5000 pound pull in the warp direction equally distributed across the fabric. All of the fabrics are heat set at about 200° F. to 400° F. depending on the yarn polymer used and weaving speed or travel of woven fabric in the machine direction. These fabrics may also be heat set after weaving as a separate treatment step.

Figure 2:
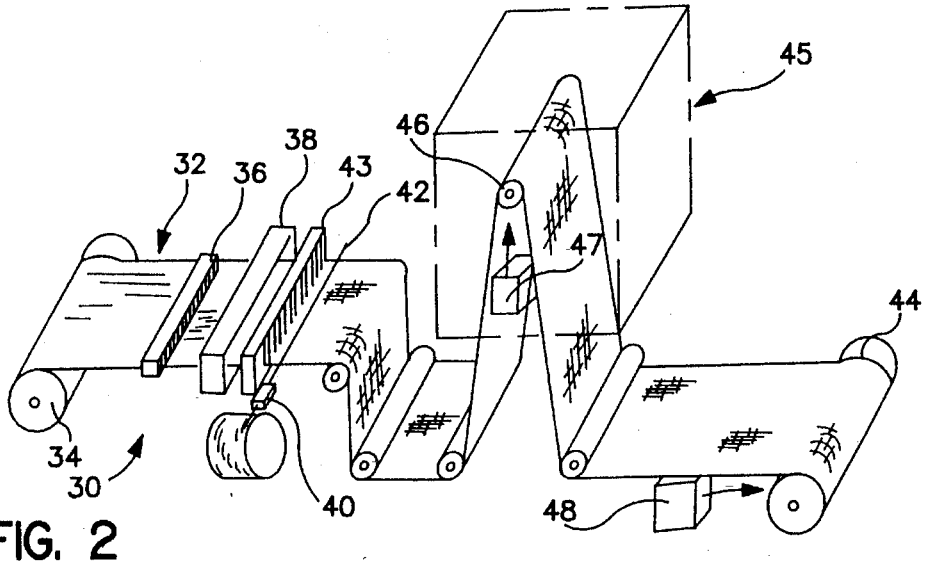
FIG. 2 is a schematic representation of a weaving loom for performing the method and producing the fabrics of the present invention.

FIG. 2 is a schematic representation of a weaving loom as could be used to weave the fabrics of the present invention. As illustrated, the loom 30 includes a source of warp yarns 32 from a beam or individual spools 34 with the warp yarns passing through harness eyes 36 to be in parallel alignment along the machine direction of the loom. The yarns 32 are uniformly and equally pulled to be in identical tension as sensed by a suitable sensing device. The loom includes means 38 for individually moving each warp yarn into or out of the loom and perpendicular or vertical to the machine direction of the loom. A shuttle or rapier 40, depending upon the type of loom, carries weft yarn 42 across the loom and between separated warp yarns 32. The warp yarns are then moved to a different order of alignments and the next weft yarn is passed across the loom. The weft yarns may be pressed against the warp yarns by a reed or comb like means 43 in a machine direction to compact the weave and the woven fabric may be advanced onto a take-up roll or accumulator 44 at a controlled speed to produce the desired woven fabric density.

The loom shown in FIG. 2 includes a heat treating means 45 that may include an internal idler roll 46 and tension monitor 47 for transporting the woven fabric through the heat treating means. The fabric is maintained under a desired tension within the heat treating means as controlling the tension at the idler roll 46 and the take-up rate at the roller 44 where the woven fabric is accumulated. The temperature within the heat treating means and the tension on the fabric is used to control both the heat setting of the woven fabric and the crimp of yarns within the fabric. Different temperatures, for example within the range of 200° F. to 400° F. and different tensions within the range of 200 to 5000 pounds uniformily applied across the warp yarns are effective to create the desired heat setting and/or crimping of the fabrics. Temperature and tension force are also selected based on the yarns used in the warp and weft of the fabric.

It should be understood that the heat setting and/or crimp may be performed after the fabric has been woven and in a suitable separate apparatus where temperature and tension may be monitored and controlled. Heat setting and crimping may also be performed with the fabric stretched on a tenting frame that applies the desired forces on the woven yarns of the fabric.

Figure 3:
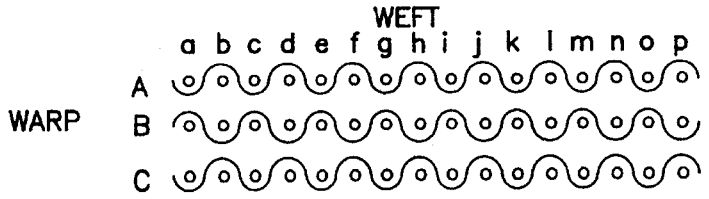
FIG. 3 is an enlarged representation of a woven fabric of the present invention.
Figure 4:
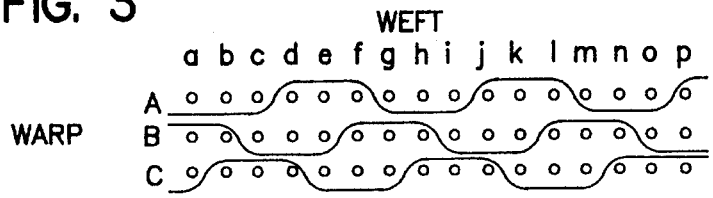
FIG. 4 is an enlarged representation of a woven twill fabric of the present invention.

The pattern of movement of the warp yarns determines the weave that will be produced in the loom. A simple over-under movement of adjacent warp yarns produces a simple weave as illustrated in FIG. 3 where warp yarn A passes over then under adjacent weft yarns a, b, c, d, etc. FIG. 4 illustrates a twill weave where adjacent warp yarns A, B and C are moved to produce a warp yarn pattern of adjacent warp yarns, for example A, passes over a first of three adjacent weft yarns a, b, and c, and then under three adjacent weft yarns d, e and f; then adjacent warp yarns, for example B, passes over a first of three weft yarns, c, d, and e, two weft yarn along the plurality of weft yarns in the direction of the warp yarns. The repeat of the over-under pattern places adjacent weft yarns under or over adjacent warp yarns in a uniformly repeating pattern across and along the woven fabric.

Figure 5:
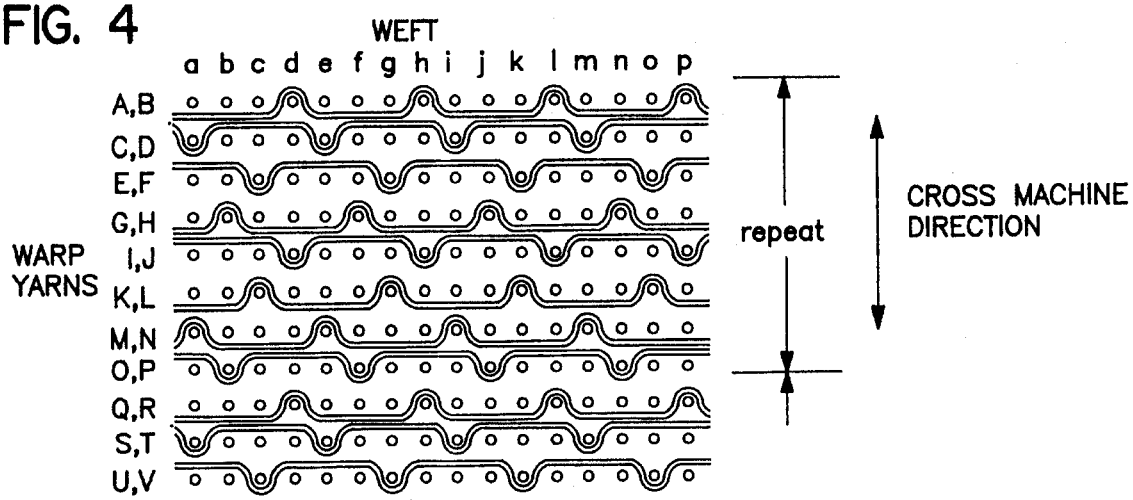
FIG. 5 is an enlarged representation of a broken twill fabric as contemplated in the present invention.

FIG. 5 illustrates a weave pattern known as a broken twill. Fabrics No. 6 and 7, previously identified, are woven in the broken twill pattern and have a pair of warp yarns drawn through each harness eye in the loom. In the case of fabrics 6 and 7 and as shown in FIG. 5, the broken twill has the following pattern:

a) two approximately 1500 denier multifilament yarns as a single untwisted warp yarn (A,B) pass together under three adjacent monofilament weft yarns (a,b,c) in the machine direction then over one adjacent weft yarn (d) in the machine direction in a repeating pattern;

b) the next adjacent two approximately 1500 denier multifilament yarns (C,D) pass together over three adjacent monofilament weft yarns (b,c,d) in the machine direction then under one adjacent weft yarn (e) in the machine direction in a repeating pattern;

c) the next adjacent two multifilament warp yarns (E,F) to "over three under one" multifilament warp yarns (C,D) in b) above going over three (d,e,f) then under one (g) weft yarn in a repeating pattern in the machine direction;

d) the next adjacent two multifilament warp yarns (G,H) to warp yarns (E,F) described in c) going under three weft yarns (c,d,e) then over the second weft yarn (f) in a repeating pattern in the machine direction;

e) the next adjacent two multifilament warp yarns (I,J) to the "under three and over one" warp yarns (G,H) in d) above, woven over three weft yarns (e,f,g) and under one weft yarn (h) in a repeating pattern in the machine direction;

f) the next adjacent two multifilament warp yarns (K,L) to warp yarns in e) above woven under three weft yarns (d,e,f) and over one weft yarn (g) in a repeating pattern in the machine direction;

g) the next adjacent tow multifilament warp yarns (M,N) to warp yarns in f) above woven under three weft yarns (b,c,d) and over one weft yarn (e) in a repeating pattern in the machine direction;

h) the next adjacent two multifilament warp yarns (O,P) to warp yarns in (g) above woven over three weft yarns (c,d,e) and under one weft yarn (f) in a repeating pattern in the machine direction;

i) the broken twill fabric is woven so that no more than two adjacent sets of two multifilament yarns described in b),c),e) and h) above occur;

j) the broken twill fabric is woven so that no more than two adjacent sets of two multifilament yarns described in a),d),f) and g) occur;

k) the broken twill fabric is woven repeating the steps a),b),c),d),e),f),g)and h) above.

When woven in this broken twill pattern, Fabric No. 6 described with weft yarns being a 15 mil monofilament ±.003 and weft yarns with crimp is more stable than Fabric No. 7 with 19–20.5 mil monofilament weft yarns with little or no crimp.

Figure 6:
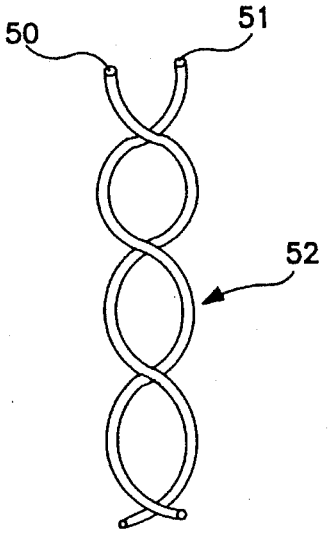
FIG. 6 is a representation of twisted warp yarns as used in the present invention.

FIG. 6 is a schematic representation of twisted pairs of yarns. As here illustrated two yarns 50 and 51 are twisted together to produce a single warp yarn 52. It should be understood that each of the yarns 50 and 51 may also be a multifilament yarn of twisted or untwisted filaments. In the case of warp yarns as used in the fabrics of the present invention, the yarns are twisted at two twists per inch to produce a first twisted yarn such as 50 or 51 and those two twisted yarns are then twisted together at two twists per inch to produce a single warp yarn 52.

Figure 7:
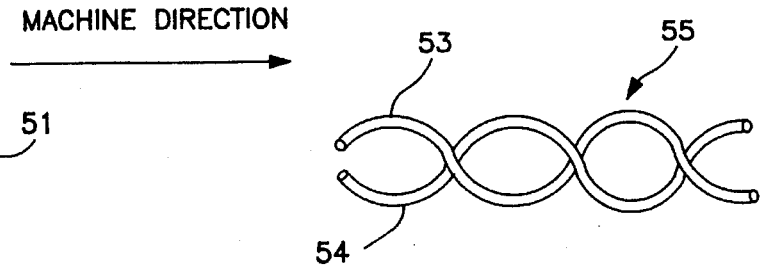
FIG. 7 is a representation of twisted weft yarns as used in the present invention.

FIG. 7 is a schematic representation of twisted pairs of yarns for weft yarns. As here illustrated two yarns 53 and 54 are twisted together to produce a single weft yarn 55. In the case of the weft yarns as used in the fabrics of the present invention, the yarns are twisted at three twists per inch to produce a first twisted yarn 53 or 54 and those two twisted yarns are then twisted together at three twists per inch to produce a single weft yarn 55.

In the case of Fabric No. 1, the weft yarn of that fabric is made of two yarns twisted together each of those yarns is a 9–13 mil monofilament twisted with a 4.00/1 or 6.00/1 or 8.00/2 spun yarn at three twists per inch, then those two yarns are twisted together at three twists per inch to form the weft yarn.

Figure 8:
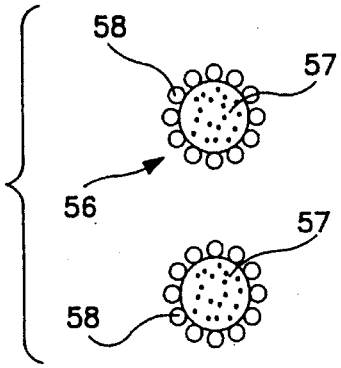
FIG. 8 is a cross-section view of a pair of wrapped yarns.

FIG. 8 is a cross-sectional view of a wrapped core yarn 56 for example the yarn used in Fabric No. 2 where a fiberglass filament core 57 is wrapped with spun yarn 58. The core yarn 57 may be a multifilament polymer yarn and the spun yarn is wrapped around the core 57 to produce the yarn shown in FIG. 8. Wrapping the fiberglass core 57 in this manner retains the strength of the multifilament core while giving the yarn exterior a spun texture.

The fabrics herein described and the method of their formation produces a woven fabric filter medium that has a plurality of warp yarns of about 2000 denier, a plurality of weft yarns or several different formations including twisted and untwisted monofilaments, multifilaments, spun and wrapped dref yarns that are woven across a machine loom to produce a fabric with warp yarns at about 69 to 71 ends per inch and with weft yarns at about 20 to 40 picks per inch, the fabric is woven in a weave pattern including conventional weaves, twill weaves and broken twill weaves, to produce a fabric that weighs about 20 to 40 ounces per square yard, and the fabric can be heat treated while the warp yarns are under tension to produce a desired amount of crimp in the yarns to thus dimensionally stabilize the fabric.

While certain preferred embodiments of the present invention have been specifically disclosed, it should be understood that the invention is not limited thereto as many variations will be readily apparent to those skilled in the art and the invention is to be given the broadest possible interpertation within the terms of the following claims.

I claim:

1. A single layer woven fabric having dimensional stability in the machine direction and in the cross machine direction for use as a filter medium with a pressure filter apparatus having separable filter plates dimensionally defining a filter chamber and means for placing said woven fabric between said plates and for moving said woven fabric when said plates are separated and wherein a fluid slurry is introduced into said chamber when said plates are closed with said woven fabric across said chamber and fuctioning to separate solids from liquids in said slurry, said woven fabric being adapted to collect solids from said slurry on one surface while passing liquids transversely through said woven fabric to produce a substantially dry filter cake on said woven fabric, said woven fabric comprising:

a) a plurality of parallel warp yarns in said woven fabric, said warp yarns being about 2,000 denier, b) a plurality of parallel weft yarns in said fabric, said weft yarns being selected from the group consisting of twisted or untwisted monofilament yarns or multifilament yarns or spun yarns or dref spun yarns, c) said warp yarns being placed under uniform tension of about 200 to about 5,000 pounds while woven with said weft yarns to accomplish initial crimp in said weft yarns, d) said woven fabric being woven in a weave with adjacent warp yarns passing over a first weft yarn and then under at least one weft yarn, adjacent warp yarns passing over and under different weft yarns in the direction of said warp yarns, e) said woven fabric having a warp ends per inch count of about 69 to 71 and a weft picks per inch count of about 20 to 40, f) said woven fabric being about 20 to 40 ounces per square yard, g) said woven fabric being heat set by being passed through a heating means while said warp yarns are under tension of about 200 to 5,000 pounds to cause said warp and weft yarns to be crimped to produce said dimensional stability.

2. The woven fabric filter medium of claim 1 wherein said woven fabric is heat set at about 200° F. to about 400° F.

3. The woven fabric filter medium of claim 1 wherein said warp and weft yarns are crimped by said tension said warp yarns and said heat setting.

4. A single layer woven fabric filter medium having dimensional stability produced on a weaving loom having separate harness eyes for each warp yarn and a weft yarn feeding means comprising, a) a plurality of parallel warp yarns, said warp yarns being about 1500 to about 3000 denier, b) a plurality of parallel weft yarns, said weft yarns being woven with said warp yarns, c) said woven fabric having a thread count in ends per inch of about 69 to 71 warp yarns per inch across said fabric and a picks per inch count of about 20 to 40 weft yarns per inch linearily along said fabric, d) said woven fabric being woven in a weave with adjacent warp yarns passing over a first weft yarn and then under at least one weft yarn, adjacent warp yarns passing over and under different weft yarns in the direction of said warp yarns, e) said woven fabric being about 20 to 40 ounces per square yard, f) said woven fabric being heat set by passing said woven fabric through a heating means while maintaining a tension of said warp yarns of about 200 to 5,000 pounds to cause said warp and weft yarns to be crimped to produce said dimensional stability.

5. The woven fabric filter medium of claim 4 wherein a) said ward yarns are pre-shrunk yarns by being heat set before weaving, and b) said weft yarns include pre-shrunk monofilament or multifilament yarn heat set before weaving with said warp yarns, and c) said warp and weft yarns are high modulus pre-shrunk yarns selected for dimensional stability and abrasion resistance.

6. The woven fabric filter medium of claim 4 wherein said warp yarns includes two 1,000 denier yarns twisted together at about two twists per inch.

7. The woven fabric of claim 6 wherein said each of said 1000 denier yarns is a multifilament yarn twisted at about two twists per inch.

8. The woven fabric filter medium of claim 4 wherein said warp yarns includes a single 2,000 denier yarn.

9. The woven fabric filter medium of claim 4 wherein each of said weft yarns includes two 9 to 13 mil monofilaments and two 2.50/1 to 8/2 spun yarns, said two monofilament yarns and two spun yarns being twisted together at about three twists per inch, and at least two of said twisted monofilament and spun yarns being twisted together at about three twists per inch to form one weft yarn, and said fabric has a warp ends per inch count of about 70 and a weft picks per inch count of about 20 to 35.

10. The woven fabric filter medium of claim 4 wherein said warp yarns are selected from the group consisting of one 2,000 denier yarn or two 1,000 denier yarns, said weft yarns includes a glass multifilament core with a spun yarn wrap, and the fabric has a warp ends per inch count of about 70 and a weft picks per inch count of about 21 to 37.

11. The woven fabric filter medium of claim 4 wherein said warp and weft yarns are selected from the group consisting of one 2,000 denier yarn or two 1,000 denier yarns, and the fabric has a warp ends per inch count of about 70 and a weft picks per inch count of about 21 to 38.

12. The woven fabric filter medium of claim 4 wherein said warp yarns are selected from the group consisting of one 2,000 denier yarn or two 1,000 denier yarns, said weft yarns includes yarns selected from the group consisting of 2.5/1 to 4.0/1 or 6.00/2 to 8.00/2 spun yarns, and the fabric has a warp ends per inch count of about 70 and a weft picks per inch count of about 20 to 40.

13. The woven fabric filter medium of claim 4 wherein said warp yarns are selected from the group consisting of one 2,000 denier yarn or two 1,000 denier yarns, said weft yarns includes yarns selected from the group consisting of 9–18 mil monofilament or two to four 4–9 mil monofilament yarns, and the fabric has a warp ends per inch count of about 70 and a weft picks per inch count of about 20 to 40.

14. The woven fabric filter medium of claim 4 wherein each of said warp yarns are two untwisted yarns pulled through each harness eye of said weaving loom, said weft yarns are an about 15 mil ±0.002 monofilament, and the fabric has a warp ends per inch count of about 120 to 140 and a weft picks per inch count of about 22 to 28.

15. The woven fabric filter medium of claim 4 wherein each of said warp yarns are two untwisted yarns pulled through each harness eye of said weaving loom, said weft yarns is one about 19 to 20.5 mil monofilament, and the fabric has a warp ends per inch count of about 120 to 140 and a weft picks per inch count of about 19.5 to 24.

16. The woven fabric filter medium of claim 4 wherein said yarns are polyesters.

17. The woven fabric filter medium of claim 4 wherein said yarns are polyproplyene.

18. The woven fabric filter medium of claim 4 wherein said yarns are nylon.

19. The woven fabric filter medium of claim 4 wherein said warp and weft yarns are selected for chemical, heat and abrasion resistance.

20. The woven fabric filter medium of claim 4 wherein said woven fabric is heat set at about 200° F. to about 400° F.

21. The woven fabric filter medium of claim 4 wherein said warp and weft yarns are crimped by said tension on said warp yarns and said heat setting.

22. The woven fabric filter medium of claim 4 wherein said weft yarns are woven in a twill weave with said warp yarns.

23. The woven fabric filter medium of claim 4 wherein said weft yarns are woven in a broken twill weave with said warp yarns.

* * * * *